US011213180B2

(12) United States Patent
Brown

(10) Patent No.: US 11,213,180 B2
(45) Date of Patent: Jan. 4, 2022

(54) AUTONOMOUS FLOOR CLEANER WITH AUDIBLE WARNING

(71) Applicant: BISSELL Inc., Grand Rapids, MI (US)

(72) Inventor: Adam Brown, Holland, MI (US)

(73) Assignee: BISSELL Inc., Grand Rapids, MI (US)

( * ) Notice: Subject to any disclaimer, the term of this patent is extended or adjusted under 35 U.S.C. 154(b) by 0 days.

(21) Appl. No.: 17/106,264

(22) Filed: Nov. 30, 2020

(65) Prior Publication Data

US 2021/0169296 A1 Jun. 10, 2021

Related U.S. Application Data

(60) Provisional application No. 62/944,593, filed on Dec. 6, 2019.

(51) Int. Cl.
*A47L 11/40* (2006.01)
*A47L 11/30* (2006.01)

(52) U.S. Cl.
CPC ..... *A47L 11/4011* (2013.01); *A47L 11/302* (2013.01); *A47L 11/4005* (2013.01); *A47L 11/4016* (2013.01); *A47L 11/4066* (2013.01); *A47L 11/4069* (2013.01); *A47L 11/4083* (2013.01); *A47L 2201/04* (2013.01); *A47L 2201/06* (2013.01)

(58) Field of Classification Search
CPC ..... A47L 11/4016; A47L 11/4005; A47L 11/302; A47L 11/4011; A47L 11/4066; A47L 11/4069; A47L 11/4083; A47L 2201/04; A47L 2201/06; A47L 2201/00; A47L 9/00; A47L 9/0063; A47L 11/282; A47L 11/40; A47L 11/4002; A47L 11/4008; A47L 11/4013; A47L 11/4088; A47L 11/4063; G01C 9/00; G01P 9/02; G08B 3/00; G08B 21/082; G08B 21/20
See application file for complete search history.

(56) References Cited

U.S. PATENT DOCUMENTS

2019/0167059 A1 6/2019 Brown et al.
2019/0191952 A1 6/2019 Johnson et al.

FOREIGN PATENT DOCUMENTS

EP 3257419 A1 12/2017
EP 3567188 A1 11/2019

*Primary Examiner* — David Redding
(74) *Attorney, Agent, or Firm* — Warner Norcross + Judd LLP

(57) ABSTRACT

An autonomous floor cleaner can include a housing, a drive system for autonomously moving the housing over the surface to be cleaned, a controller for controlling the operation of the autonomous floor cleaner, and warning system for issuing an audible warning based on an orientation or operational condition of the robot. Methods for issuing an audible warning are disclosed.

20 Claims, 7 Drawing Sheets

AUTONOMOUS FLOOR CLEANER WITH AUDIBLE WARNING

CROSS-REFERENCE TO RELATED APPLICATION(S)

The present application claims the benefit of U.S. Provisional Application No. 62/944,593, filed Dec. 6, 2019, which is incorporated herein by reference in its entirety.

BACKGROUND

Autonomous or robotic floor cleaners can move without the assistance of a user or operator to clean a floor surface. For example, the floor cleaner can be configured to vacuum or sweep dirt (including dust, hair, and other debris) into a collection bin carried on the floor cleaner. The floor cleaner can move randomly about a surface while cleaning the floor surface or use a mapping/navigation system for guided navigation about the surface. Some floor cleaners are further configured to apply and/or extract liquid for wet cleaning of bare floors, carpets, rugs, and other floor surfaces.

One noted problem with current autonomous floor cleaners is improper use by consumers. Consumer misuse can be particularly problematic for wet robotic cleaners, which hold liquid in one or more on-board tanks. This liquid can spill inside the wet robotic cleaner if the user is not careful.

BRIEF SUMMARY

In one aspect, the disclosure relates to an autonomous floor cleaner.

In one embodiment, the autonomous floor cleaner includes an autonomously moveable housing, a drive system for autonomously moving the housing over the surface to be cleaned, a controller for controlling the operation of the autonomous floor cleaner, and a warning system for issuing an audible warning based on an orientation or operational condition of the autonomous floor cleaner. The warning system can include at least one speaker on the housing.

In some embodiments, the controller can receive inputs from at least one sensor, and at least one audible warning can be issued based on input from the at least one sensor. In certain embodiments, the at least one sensor is an IMU, a gyroscope, a lift-up sensor, a cliff sensor, or a moisture sensor inside the housing.

In certain embodiments, the autonomous floor cleaner includes a fluid delivery system. The fluid delivery system can include a supply tank for storing a supply of cleaning fluid and at least one fluid distributor in fluid communication with the supply tank. An audible warning can be issued when the autonomous floor cleaner is oriented at a tilt angle that meets or exceeds a predetermined tilt angle. Optionally, the predetermined tilt angle is a tilt angle at which liquid can spill out of the supply tank.

In certain embodiments, the autonomous floor cleaner includes a collection system including a recovery tank for receiving recovered liquid and/or debris for later disposal. In one embodiment, an audible warning can be issued when the autonomous floor cleaner is oriented at a tilt angle that meets or exceeds a predetermined tilt angle. Optionally, the predetermined tilt angle is a tilt angle at which liquid can spill out of the recovery tank.

In another aspect, various methods for issuing an audible warning for an autonomous floor cleaner are described herein.

In one embodiment, an audible warning for an autonomous floor cleaner is issued based on an orientation or operational condition of the autonomous floor cleaner. The orientation or operational condition can be detected by at least one on-board sensor of the robot. In certain embodiments, the orientation or operational condition is one of: the robot being lifted off the surface to be cleaned, the robot being tilted past a predetermined angle, the robot being flipped upside down, or the presence of moisture inside the housing. Optionally, the robot can continue to issue the audible warning until the user acknowledges that the audible warning was received.

These and other features and advantages of the present disclosure will become apparent from the following description of particular embodiments, when viewed in accordance with the accompanying drawings and appended claims.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. In addition, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components. Any reference to claim elements as "at least one of X, Y and Z" is meant to include any one of X, Y or Z individually, and any combination of X, Y and Z, for example, X, Y, Z; X, Y; X, Z; and Y, Z.

DETAILED DESCRIPTION

The disclosure generally relates to autonomous floor cleaners for cleaning floor surfaces, including bare floors such as hardwood, tile, and stone, and soft surfaces such as carpets and rugs. More specifically, the disclosure relates to warning systems and methods for issuing warnings for autonomous floor cleaners.

Figure 1:
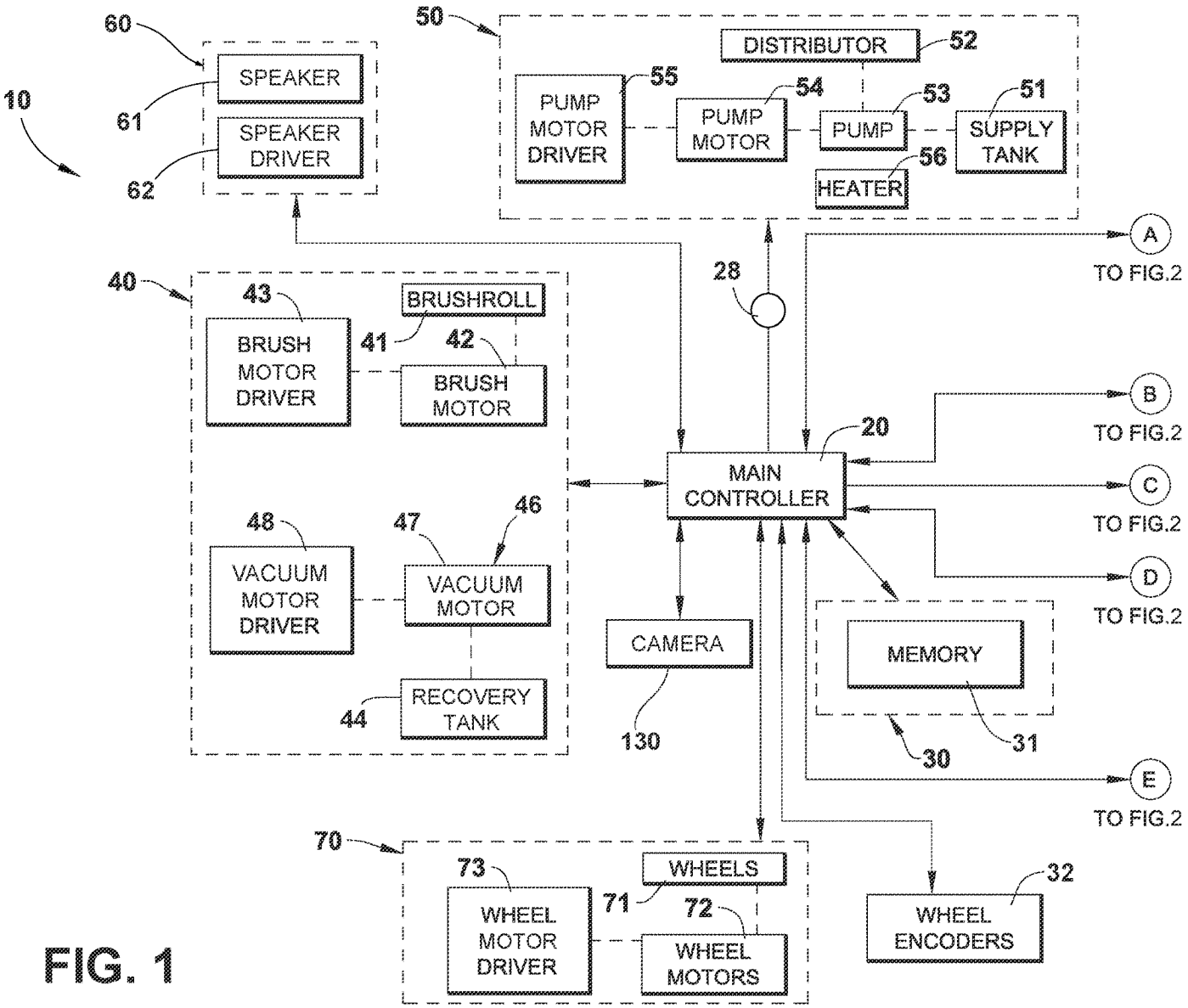
FIG. 1 is a schematic view of an exemplary autonomous floor cleaner illustrating functional systems in accordance with various aspects described herein.
Figure 2:
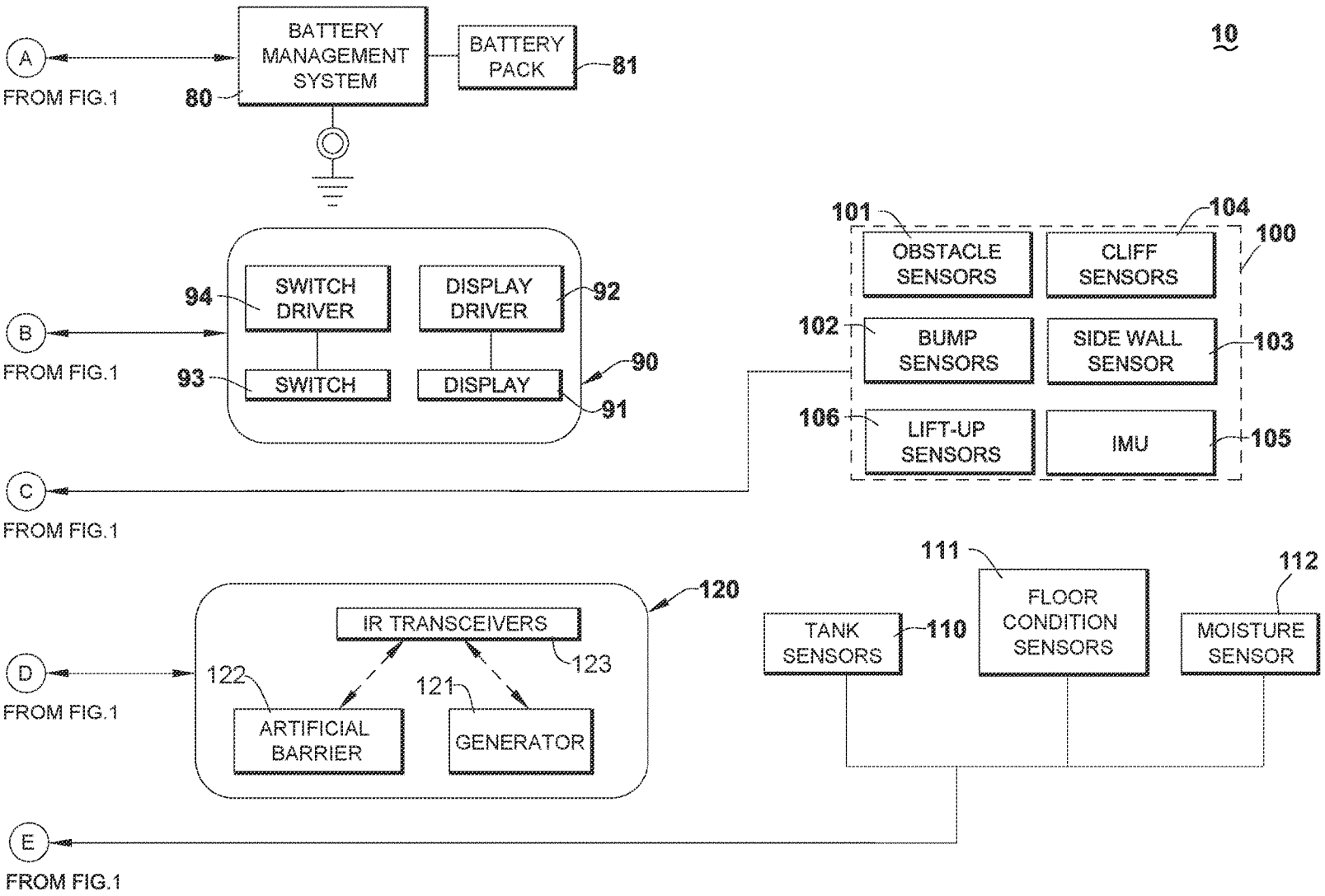
FIG. 2 is a schematic view of the autonomous floor cleaner of FIG. 1 illustrating additional functional systems in accordance with various aspects described herein.

FIGS. 1 and 2 illustrate a schematic view of an autonomous floor cleaner, such as a floor cleaning robot 10, also referred to herein as a robot 10. The robot 10 can clean various floor surfaces, including bare floors such as hardwood, tile, and stone, and soft surfaces such as carpets and rugs. The robot 10 can issue an audible warning based on an orientation or operational condition of the robot 10. It is noted that the robot 10 shown in FIGS. 1-2 is but one example of an autonomous floor cleaner that can issue an audible warning and perform the methods described herein, and that other autonomous floor cleaners can be used.

In one embodiment, the robot 10 can be a deep cleaning robot including a fluid delivery system for storing cleaning fluid and delivering the cleaning fluid to the surface to be cleaned and a fluid recovery system for removing the cleaning fluid and debris from the surface to be cleaned and storing the recovered cleaning fluid and debris. The fluid delivery system may be configured to delivery liquid, steam, mist, or vapor to the surface to be cleaned.

In another embodiment, the robot 10 can be a wet mopping or sweeping robot including a fluid delivery system for storing cleaning fluid and delivering the cleaning fluid to the surface to be cleaned and a mopping or sweeping system for removing cleaning fluid and debris from the surface to be cleaned without the use of suction. The fluid delivery system may be configured to delivery liquid, steam, mist, or vapor to the surface to be cleaned.

In yet another embodiment, the robot 10 can be a dry vacuum cleaning robot including at least a vacuum collection system for creating a partial vacuum to suck up debris (which may include dirt, dust, soil, hair, and other debris) from a floor surface, and collect the removed debris in a space provided on the robot for later disposal.

In still another embodiment, the robot 10 can be a dry sweeping robot including a sweeping system for removing dry debris from the surface to be cleaned without the use of suction, and collect the removed debris in a space provided on the robot for later disposal.

The robot 10 mounts the components various functional systems of the autonomous floor cleaner in an autonomously moveable unit or housing 12 (FIG. 3), optionally including components of a navigation/mapping system 30, a collection system 40, a fluid delivery system 50, a drive system 70, or any combination thereof. A controller 20 is operably coupled with the various functional systems 30, 40, 50, 70 of the robot 10 for controlling the operation of the robot 10. The controller 20 can be a microcontroller unit (MCU) that contains at least one central processing unit (CPU).

A navigation/mapping system 30 can be provided in the robot 10 for guiding the movement of the robot 10 over the surface to be cleaned, generating and storing maps of the surface to be cleaned, and recording status or other environmental variable information. The controller 20 can receive input from the navigation/mapping system 30 or from a remote device such as a smartphone (not shown) for directing the robot 10 over the surface to be cleaned. The navigation/mapping system 30 can include a memory 31 that can store any data useful for navigation, mapping or conducting a cycle of operation, including, but not limited to, maps for navigation, inputs from various sensors that are used to guide the movement of the robot 10, etc. For example, wheel encoders 32 can be placed on the drive shafts of wheels coupled to the robot 10 and configured to measure a distance traveled by the robot 10. The distance measurement can be provided as input to the controller 20.

In an autonomous mode of operation, the robot 10 can be configured to travel in any pattern useful for cleaning or sanitizing including boustrophedon or alternating rows (that is, the robot 10 travels from right-to-left and left-to-right on alternate rows), spiral trajectories, etc., while cleaning the floor surface, using input from various sensors to change direction or adjust its course as needed to avoid obstacles. In a manual mode of operation, movement of the robot 10 can be controlled using a mobile device such as a smartphone or tablet.

The embodiment of the robot 10 shown in FIG. 1 can also include at least the components of a vacuum collection or recovery system 40 for removing liquid and debris from the surface to be cleaned, a fluid delivery system 50 for storing cleaning fluid and delivering the cleaning fluid to the surface to be cleaned, and a drive system 70 for autonomously moving the robot 10 over the surface to be cleaned.

The collection system 40 can include a recovery pathway through the housing 12 having an air inlet defined by a suction nozzle 45 (FIGS. 3-4) and an air outlet (not shown), a debris receptacle, bin, or recovery tank 44 for receiving recovered liquid and/or debris for later disposal, and a suction source 46 in fluid communication with the suction nozzle 45 and the recovery tank 44 for generating a working air stream through the recovery pathway. The suction source 46 can include a vacuum motor 47 located fluidly upstream of the air outlet, and can define a portion of the recovery pathway.

The suction nozzle 45 shown herein is positioned in close proximity to the brushroll 41 to collect liquid and debris directly from the brushroll 41. In other embodiments, the suction nozzle 45 can be positioned to confront the surface to be cleaned to remove liquid and debris from the surface, rather than the brushroll 41.

The recovery tank 44 can define a portion of the recovery pathway and can comprise a separator (not shown) for separating liquid and debris from the working airstream. Optionally, a pre-motor filter and/or a post-motor filter (not shown) can be provided in the recovery pathway as well. The recovery pathway can further include various conduits, ducts, or tubes for fluid communication between the various components of the collection system 40. The vacuum motor 47 can be positioned downstream of the recovery tank 44 in the recovery pathway. In other embodiments, the vacuum motor 47 may be located fluidly upstream of the recovery tank 44.

The collection system 40 can also include at least one agitator for agitating the surface to be cleaned. The agitator can be in the form of a brushroll 41 mounted for rotation about a substantially horizontal axis, relative to the surface over which the robot 10 moves. A drive assembly including a separate, dedicated brush motor 42 can be provided within the robot 10 to drive the brushroll 41. Other agitators or brushrolls can also be provided, including one or more stationary or non-moving brushes, or one or more brushes that rotate about a substantially vertical axis.

The fluid delivery system 50 can include a supply tank 51 for storing a supply of cleaning fluid and at least one fluid distributor 52 in fluid communication with the supply tank 51 for depositing a cleaning fluid onto the surface. The cleaning fluid can be a liquid such as water or a cleaning solution specifically formulated for hard or soft surface cleaning. The fluid distributor 52 can be one or more spray nozzles provided on the housing 12 with an orifice of sufficient size such that debris does not readily clog the nozzle. Alternatively, the fluid distributor 52 can be a manifold having multiple distributor outlets.

A pump 53 can be provided in the fluid pathway between the supply tank 51 and the at least one fluid distributor 52 to control the flow of fluid to the at least one fluid distributor 52. The pump 53 can be driven by a pump motor 54 to move liquid at any flowrate useful for a cleaning cycle of operation. In some embodiments, the pump 53 can be driven according to a pulse-width modulation (PWM) signal 28, by which the controller 20 can provide for any suitable or customized flow rate, including a low flow rate, from the pump 53 being powered from the battery pack 81.

Various combinations of optional components can also be incorporated into the fluid delivery system 50, such as a heater 56 or one or more fluid control and mixing valves. The heater 56 can be configured, for example, to warm up the cleaning fluid before it is applied to the surface. In one embodiment, the heater 56 can be an in-line fluid heater between the supply tank 51 and the distributor 52. In another example, the heater 56 can be a steam generating assembly. The steam assembly is in fluid communication with the supply tank 51 such that some or all the liquid applied to the floor surface is heated to vapor.

The drive system 70 can include drive wheels 71 for driving the robot 10 across a surface to be cleaned. The drive wheels 71 can be operated by a common wheel motor 72 or individual wheel motors coupled with the drive wheels 71 by a transmission, which may include a gear train assembly or another suitable transmission. The drive system 70 can receive inputs from the controller 20 for driving the robot 10 across a floor, based on inputs from the navigation/mapping system 30 for the autonomous mode of operation or based on inputs from a smartphone, tablet, or other remote device for the manual mode of operation. The drive wheels 71 can be driven in a forward or reverse direction to move the unit forwardly or rearwardly. Furthermore, the drive wheels 71 can be operated simultaneously at the same rotational speed for linear motion or independently at different rotational speeds to turn the robot 10 in a desired direction.

The robot 10 can include any number of motors useful for performing locomotion and cleaning. In one example, four dedicated motors can be provided to rotate the brushroll 41, each of two drive wheels 71, and generate a partial vacuum at the suction nozzle 45. In another example, one shared motor can rotate the brushroll 41 and generate a partial vacuum at the suction nozzle 45, and a second and third motor can rotate each drive wheel 71. In still another example, one shared motor can rotate the brushroll 41 and generate a partial vacuum at the suction nozzle 45, and a second shared motor can rotate both drive wheels 71.

In addition, a brush motor driver 43, a vacuum motor driver 48, pump motor driver 55, and wheel motor driver 73 can be provided for controlling the brush motor 42, pump motor 54, and wheel motors 72, respectively. The motor drivers 43, 48, 55, 73 can act as an interface between the controller 20 and their respective motors 42, 47, 54, 72. The motor drivers 43, 48, 55, 73 can also be an integrated circuit chip (IC). It is also contemplated that a single wheel motor driver 73 can control multiple wheel motors 72 simultaneously.

Turning to FIG. 2, the motor drivers 43, 48, 55, 73 (FIG. 1) can be electrically coupled to a battery management system 80 that includes a built-in rechargeable battery or removable battery pack 81. In one example, the battery pack 81 can include lithium ion batteries. Charging contacts for the battery pack 81 can be provided on an exterior surface of the robot 10. A docking station (not shown) can be provided with corresponding charging contacts that can mate to the charging contacts on the exterior surface of the robot 10. The battery pack 81 can be selectively removable from the robot 10 such that it can be plugged into mains voltage via a DC transformer for replenishment of electrical power, i.e. charging. When inserted into the robot 10, the removable battery pack 81 can be at least partially located outside the housing 12 (FIG. 3) or completely enclosed in a compartment within the housing 12, in non-limiting examples and depending upon the implementation.

The controller 20 is further operably coupled with a user interface (UI) 90 on the robot 10 for receiving inputs from a user. The user interface 90 can be used to select an operation cycle for the robot 10 or otherwise control the operation of the robot 10. The user interface can also be used to provide information to the user. For instance, in some embodiments, the user interface 90 can issue at least one warning to a user.

In one embodiment, the user interface 90 can have a display 91, such as an LED display, for providing visual notifications to the user. A display driver 92 can be provided for controlling the display 91, and acts as an interface between the controller 20 and the display 91. The display driver 92 may be an IC.

The user interface 90 can further have one or more switches 93 that are actuated by the user to provide input to the controller 20 to control the operation of various components of the robot 10. A switch driver 94 can be provided for controlling the switch 93, and acts as an interface between the controller 20 and the switch 93.

The robot 10 can comprise an on-board Wi-Fi connection that is configured to allow the robot 10 to be controlled remotely through a mobile device, such as a smartphone or tablet, or via a voice-controlled remote device such as an Amazon Echo® or Amazon Echo Dot® having the Amazon Alexa® cloud-based voice service, or a Google Home® or Google Home Mini® having Google Assistant. For example, a user with a smart speaker device can speak an instruction, such as "Alexa, ask [robot] to start cleaning," and via the Wi-Fi and/or Internet connectivity, the robot 10 can begin a cleaning cycle of operation.

A smart device application for the robot 10 that is executed on a mobile or remote device can include further command and control features including, but not limited to, scheduling features to enable a user to select when the robot 10 will conduct cleaning. Other features of the smart device application cam include a display of the robot's cleaning history, a landing page with current blogs and support videos related to the robot 10, and controls to automatically reorder accessories for the robot 10 when needed. The smart device application can also be configured to provide detailed notifications relating diagnostics, error warnings, and other information directly to the user.

Figure 3:
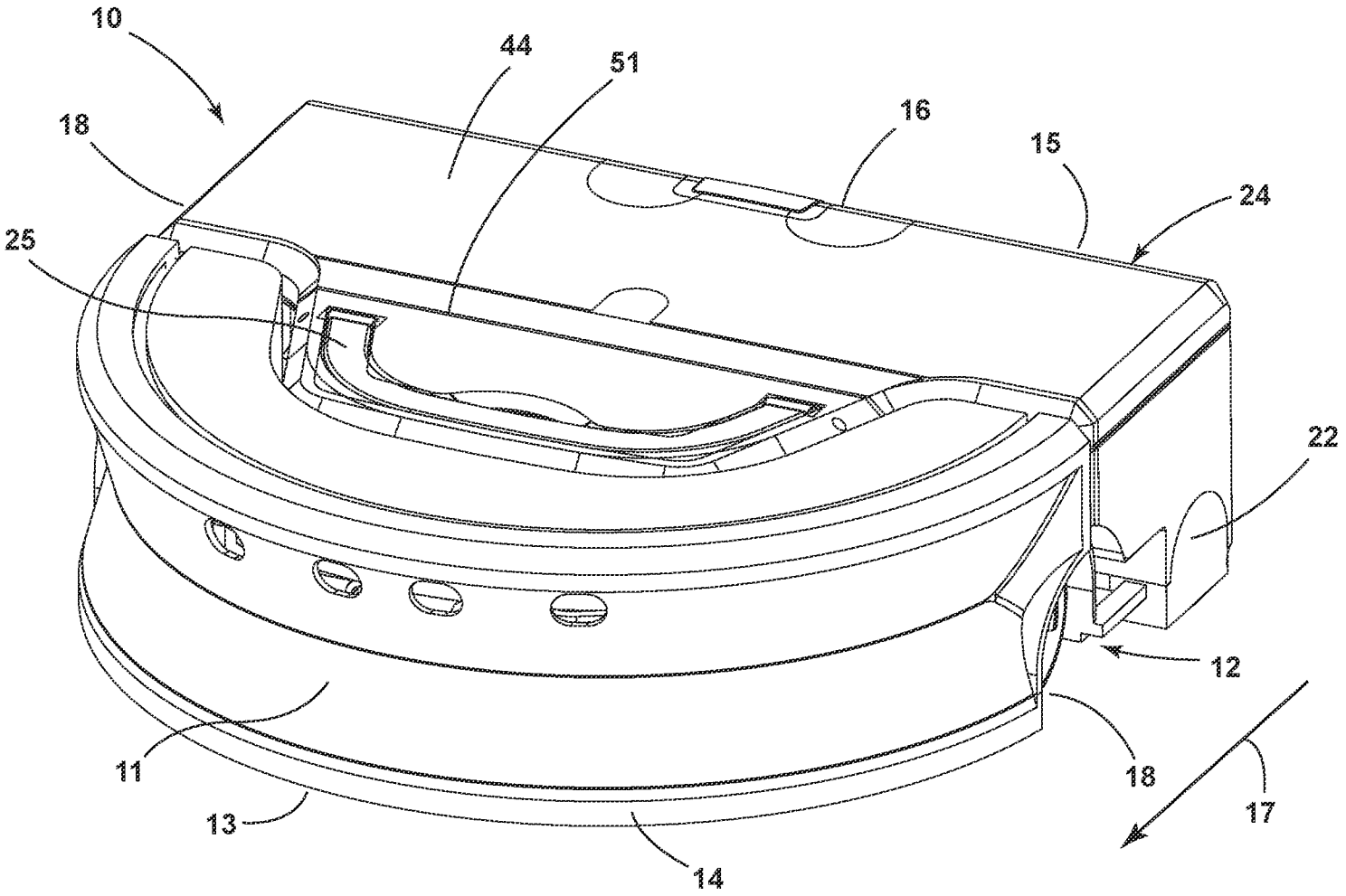
FIG. 3 is a front isometric view of the autonomous floor cleaner of FIG. 1 in the form of a floor cleaning robot in accordance with various aspects described herein.

The robot 10 can further be provided with a system 60 for providing audible notifications, including, but not limited to, warnings regarding the orientation and/or operation of the robot 10, to the user. Examples of audible notifications include announcements such as beeps, tones or a prerecorded voice. The system 60 can include at least one speaker 61 and speaker driver 62. The speaker 61 and speaker driver 62 can be on-board the housing 12 (FIG. 3). The speaker driver 62 controls the speaker 61 and acts as an interface between the controller 20 and the speaker 61. The speaker driver 62 may be an IC.

The robot 10 can be provided with one or more cameras or stereo cameras 130 for acquiring visible notifications from the user. In this way, the user can communicate instructions to the robot 10 by gestures. For example, the user can wave their hand in front of the camera to instruct the robot 10 to stop or move away. In one embodiment, the user can execute a gesture in front of the camera 130 that acknowledges that an audible warning was heard/received by the user. The gesture can further instruct the robot 10 to stop issuing the audible warning.

The controller 20 can further be operably coupled with various sensors for receiving input about the environment and can use the sensor input to control the operation of the robot 10. The sensors can detect features of the surrounding environment of the robot 10 including, but not limited to, walls, floors, chair legs, table legs, footstools, pets, consumers, and other obstacles. The sensor input can further be stored in the memory or used to develop maps for navigation. Some exemplary sensors are illustrated in FIG. 2, and described below. Although it is understood that not all sensors shown may be provided, additional sensors may be provided, and that all of the possible sensors can be provided in any combination. In one embodiment, at least one audible warning can be issued based on input from one or more sensors.

The robot 10 can include a positioning or localization system 100. The localization system 100 can include one or more sensors, including but not limited to the sensors described above. In one non-limiting example, the localization system 100 can include obstacle sensors 101 determining the position of the robot 10, such as a stereo camera in a non-limiting example, for distance and position sensing. The obstacle sensors 101 can be mounted to the housing 12 (FIG. 3) of the robot 10, such as in the front of the housing 12 to determine the distance to obstacles in front of the robot 10. Input from the obstacle sensors 101 can be used to slow down or adjust the course of the robot 10 when objects are detected. In one embodiment, the robot 10 can issue at least one audible warning based on input from the positioning or localization system 100.

Bump sensors 102 can also be provided in the localization system 100 for determining front or side impacts to the robot 10. The bump sensors 102 may be integrated with the housing 12, such as with a bumper 14 (FIG. 3). Output signals from the bump sensors 102 provide inputs to the controller for selecting an obstacle avoidance algorithm.

The localization system 100 can further include a side wall sensor 103 (also known as a wall following sensor) and a cliff sensor 104. The side wall sensor 103 or cliff sensor 104 can be optical, mechanical, or ultrasonic sensors, including reflective or time-of-flight sensors. The side wall sensor 103 can be located near the side of the housing 12 and can include a side-facing optical position sensor that provides distance feedback and controls the robot 10 so that the robot 10 can follow near a wall without contacting the wall. The cliff sensors 104 can be bottom-facing optical position sensors that provide distance feedback and control the robot 10 so that the robot 10 can avoid excessive drops down stairwells, ledges, etc. Optionally, input from one or more cliff sensors 104 can be used by the controller 20 to determine if the robot 10 is in an orientation or operational condition in which an audible warning should be issued. If affirmative, an audible warning is issued from the speaker 61.

The localization system 100 can also include an inertial measurement unit (IMU) 105 to measure and report the robot's acceleration, angular rate, or magnetic field surrounding the robot 10, using a combination of at least one accelerometer, gyroscope, and, optionally, magnetometer or compass. The inertial measurement unit 105 can be an integrated inertial sensor located on the controller 20 and can be a nine-axis gyroscope or accelerometer to sense linear, rotational or magnetic field acceleration. The IMU 105 can use acceleration input data to calculate and communicate change in velocity and pose to the controller 20 for navigating the robot 10 around the surface to be cleaned. Optionally, input from the IMU 105 can be used by the controller 20 to determine if the robot 10 is in an orientation or operational condition in which an audible warning should be issued. If affirmative, an audible warning is issued from the speaker 61.

The localization system 100 can further include one or more lift-up sensors 106 which detect when the robot 10 is lifted off the surface to be cleaned e.g. if a user picks up the robot 10. This information is provided as an input to the controller 20, which can halt operation of the pump motor 54, brush motor 42, vacuum motor 47, or wheel motors 72 in response to a detected lift-up event. The lift-up sensors 106 may also detect when the robot 10 is in contact with the surface to be cleaned, such as when the user places the robot 10 back on the ground. Upon such input, the controller 20 may resume operation of the pump motor 54, brush motor 42, vacuum motor 47, or wheel motors 72. Optionally, input from one or more lift-up sensors 106 can be used by the controller 20 to determine if the robot 10 is in an orientation or operational condition in which an audible warning should be issued. If affirmative, an audible warning is issued from the speaker 61.

In another embodiment, the robot 10 can use the IMU 105 to detect when the robot 10 is lifted off the surface to be cleaned and/or when the robot 10 is in contact with the surface to be cleaned. In this case, the one or more lift-up sensors 106 may not be provided on the robot 10.

In yet another embodiment, the robot 10 can use the cliff sensors 104 to detect when the robot 10 is lifted off the surface to be cleaned and/or when the robot 10 is in contact with the surface to be cleaned. In this case, the one or more lift-up sensors 106 may not be provided on the robot 10.

The robot 10 can issue one or more audible warnings to a user, for instance when the robot 10 is improperly oriented or otherwise being used incorrectly. An audible warning can be issued from the on-board speaker 61. Additionally or alternatively, an audible warning can be issued from a mobile device such as a smartphone or tablet, or from another remote device having a speaker, including, but not limited to, a voice-controlled remote device such as an Amazon Echo® or Amazon Echo Dot® having the Amazon Alexa® cloud-based voice service, or a Google Home® or Google Home Mini® having Google Assistant.

The robot 10 can optionally include one or more tank sensors 110 for detecting a characteristic or status of the recovery tank 44 or supply tank 51. In one example, one or more pressure sensors for detecting the weight of the recovery tank 44 or supply tank 51 can be provided. In another example, one or more magnetic sensors for detecting the presence of the recovery tank 44 or supply tank 51 can be provided. This information is provided as an input to the controller 20, which may prevent operation of the robot 10 until the supply tank 51 is filled, the recovery tank 44 is emptied, or both are properly installed, in non-limiting examples. The controller 20 may also direct the display 91 to provide a notification to the user that either or both of the tanks 44, 51 is missing.

The robot 10 can optionally include one or more floor condition sensors 111 for detecting a condition of the surface to be cleaned. For example, the robot 10 can be provided with an infrared (IR) dirt sensor, a stain sensor, an odor sensor, or a wet mess sensor. The floor condition sensors 111 provide input to the controller that may direct operation of the robot 10 based on the condition of the surface to be cleaned, such as by selecting or modifying a cleaning cycle. Optionally, the floor condition sensors 111 can also provide input for display on a smartphone.

The robot 10 can optionally include at least one moisture sensor 112 for detecting moisture inside the housing 12. The moisture sensor 112 provides input to the controller that may direct operation of the robot 10 based on the presence of moisture inside the robot, such as by modifying or stopping a cleaning cycle until the interior of the robot 10 is dry. Optionally, input from the moisture sensor 112 can be used by the controller 20 to determine if the interior of the robot 10 is wet. If affirmative, an audible warning is issued from the speaker 61. The moisture sensor 112 can be disposed inside the housing 12, but outside of the supply tank 51 or recovery tank 44, to sense moisture at an interior location of the robot 10 that is typically dry. Sensing moisture at such a location can be indicative of a spill inside the robot 10, for example by liquid spilling out of the supply tank 51 or recovery tank 44.

An artificial barrier system 120 can also be provided for containing the robot 10 within a user-determined boundary. The artificial barrier system 120 can include an artificial barrier generator 121 that comprises a barrier housing with at least one signal receiver for receiving a signal from the robot 10 and at least one IR transmitter for emitting an encoded IR beam towards a predetermined direction for a predetermined period of time. The artificial barrier generator 121 can be battery-powered by rechargeable or non-rechargeable batteries or directly plugged into mains power. In one non-limiting example, the receiver can comprise a microphone configured to sense a predetermined threshold sound level, which corresponds with the sound level emitted by the robot 10 when it is within a predetermined distance away from the artificial barrier generator. Optionally, the artificial barrier generator 121 can further comprise a plurality of IR emitters near the base of the barrier housing configured to emit a plurality of short field IR beams around the base of the barrier housing. The artificial barrier generator 121 can be configured to selectively emit one or more IR beams for a predetermined period of time, but only after the microphone senses the threshold sound level, which indicates the robot 10 is nearby. Thus, the artificial barrier generator 121 can conserve power by emitting IR beams only when the robot 10 is near the artificial barrier generator 121.

The robot 10 can have a plurality of IR transceivers (also referred to as "IR XCVRs") 123 around the perimeter of the robot 10 to sense the IR signals emitted from the artificial barrier generator 121 and output corresponding signals to the controller 20, which can adjust drive wheel control parameters to adjust the position of the robot 10 to avoid boundaries established by the artificial barrier encoded IR beam and the short field IR beams. Based on the received IR signals, the controller 20 prevents the robot 10 from crossing an artificial barrier 122 or colliding with the barrier housing. The IR transceivers 123 can also be used to guide the robot 10 toward the docking station, if provided.

In operation, sound (or light) emitted from the robot 10 greater than a predetermined threshold signal level is sensed by the microphone (or photodetector) and triggers the artificial barrier generator 121 to emit one or more encoded IR beams for a predetermined period of time. The IR transceivers 123 on the robot 10 sense the IR beams and output signals to the controller 20, which then manipulates the drive system 70 to adjust the position of the robot 10 to avoid the barriers 122 established by the artificial barrier system 120 while continuing to perform a cleaning operation on the surface to be cleaned.

The robot 10 can operate in one of a set of modes. The modes can include a wet mode, a dry mode, and a sanitization mode. During a wet mode of operation, liquid from the supply tank 51 is applied to the floor surface and the brushroll 41 is rotated. During a dry mode of operation, the brushroll 41 is rotated and no liquid is applied to the floor surface. During a sanitizing mode of operation, liquid from the supply tank 51 is applied to the floor surface, the brushroll 41 is rotated, and the robot 10 can select a travel pattern such that the applied liquid remains on the surface of the floor for a predetermined length of time. The predetermined length of time can be any duration that will result in sanitizing floor surfaces including, but not limited to, two to five minutes. However, sanitizing can be effected with durations of less than two minutes and as low as fifteen seconds. During each of the wet mode, dry mode, and sanitization modes of operation, a partial vacuum can be generated at the suction nozzle 45 by the suction source 46 to collect liquid and/or debris in the recovery tank 44.

Figure 4:
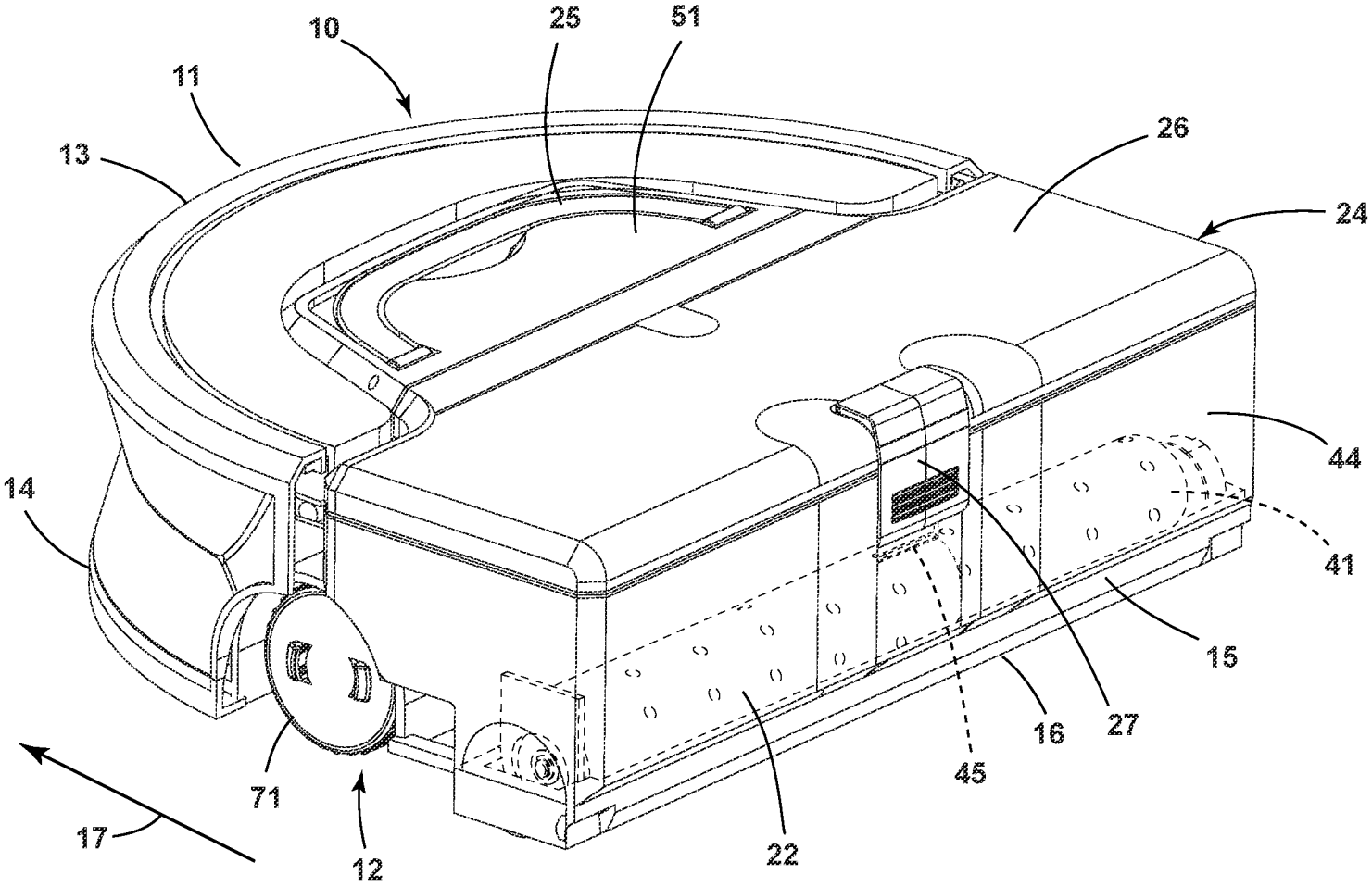
FIG. 4 is a rear isometric view of the floor cleaning robot of FIG. 3.
Figure 5:
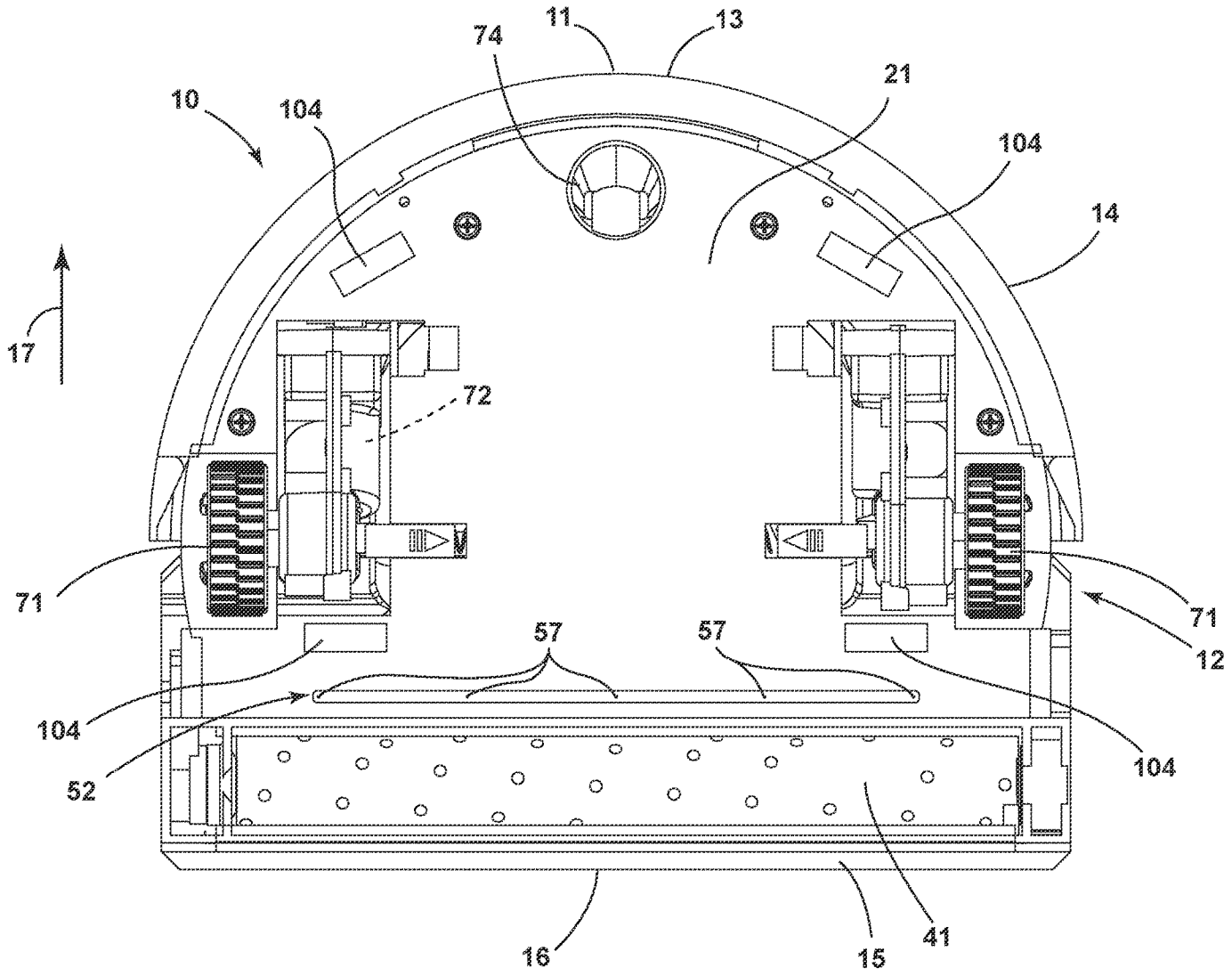
FIG. 5 is a bottom view of the floor cleaning robot of FIG. 3.

FIGS. 3-5 illustrate an exemplary robot 10 that can include the systems and functions described in FIGS. 1-2. As shown, the robot 10 can include a D-shaped housing 12 with a first end 13 and a second end 15. The first end 13 defines a housing front 11 of the robot 10 that is a rounded portion of the D-shaped housing 12, and can be formed by the bumper 14. The second end 15 can define a housing rear 16 that is a straightedge portion of the D-shaped housing 12. Other shapes and configurations for the robot 10 are possible, including that the rounded portion of the D-shaped housing 12 can define the housing front, and the straightedge portion of the D-shaped housing 12 can define the housing rear.

Forward motion of the robot 10 is illustrated with an arrow 17, and the bumper 14 wraps around the first end 13 of the robot 10 to cover the housing front 11 of the robot 10. During a collision with an obstacle, the bumper 14 can shift or translate to register a detection of an object. The bumper 14 can also wrap around and cover a portion of each lateral side 18 of the robot 10. The lateral sides 18 of the robot extend between the first end 13 or housing front 11 of the robot 10 and the second end 15 or housing rear 16 of the robot 10.

A rear isometric view of the robot 10 is shown in FIG. 4. The robot 10 can include the brushroll 41 and at least one wheel assembly with a drive wheel 71. The brushroll 41 can be positioned within a brush chamber 22, which can define the suction nozzle 45. The brushroll 41 and brush chamber 22 can be located proximate the second end 15, e.g. proximate the straightedge portion of the housing 12. Along the underside 21 of the robot 10 and with respect to the direction of forward motion indicated by arrow 17, the brushroll 41 is mounted behind the drive wheels 71. In addition, the recovery tank 44 can be positioned adjacent the brushroll 41 and brush chamber 22. In the illustrated example, the recovery tank 44 is positioned above the brush chamber 22 and brushroll 41, and partially above the drive wheels 71. The supply tank 51 can be positioned rearwardly of the recovery tank 44, and also rearwardly of the brush chamber 22, brushroll 41, and drive wheels 71. Other configurations of the supply tank 51 are possible.

The recovery tank 44 and supply tank 51 can be at least partially formed from a translucent or transparent material, such that an interior space of the tanks 44, 51 is visible to the user. The brush chamber 22 can be at least partially formed from a translucent or transparent material, such that the use can view the brushroll 41.

The recovery tank 44 and supply tank 51 can be separate components on the housing 12. Alternately, the recovery tank 44 and supply tank 51 can be integrated into a single unitary or integrated tank assembly 24 as shown. It is contemplated that the tank assembly 24 can be selectively removed by a consumer such that both the recovery tank 44 and supply tank 51 are removed together in one action. The tank assembly 24 can be attached to the housing 12 using any suitable mechanism, including any suitable latch, catch, or other mechanical fastener that can join the tank assembly 24 and housing 12, while allowing for the regular separation of the tank assembly 24 from the housing 12. A handle 25 can be provided on the tank assembly 24, wherein a user can grasp the handle 25 to lift the tank assembly 24 from the housing 12.

It is further contemplated that the tank assembly 24 can at least partially, or fully, define the brush chamber 22 and suction nozzle 45, such that the brush chamber 22 and suction nozzle 45 are also removed upon removal of the tank assembly 24. This can improve usability and serviceability, wherein a consumer can remove the tank assembly 24 in a single action to empty and rinse out the recovery tank 44, clean the brush chamber 22 and suction nozzle 45, and fill the supply tank 51.

The recovery tank 44 can have an openable cover 26 to facilitate emptying the collected contents of the tank 44. A release button 27 or other actuator can optionally be provided for unlatching or detaching the cover 26 from the recovery tank 44. It is further contemplated that the supply tank 51 can be selectively removable from the recovery tank 44 when the tank assembly 24 is detached from the housing 12.

A bottom view of the robot 10 is shown in FIG. 5, where an underside 21 of the housing 12 is visible. In addition to the two drive wheels 71, the robot 10 can also include at least one caster 74 to maintain a minimum spacing between the surface to be cleaned and the underside 21 of the robot 10. The caster 74 can include a wheel mounted on an axle, or an omnidirectional ball for rolling in multiple directions, in non-limiting examples. The caster 74 can, in one example, be positioned proximate to the first end 13 or housing front 11.

In the example shown, the fluid distributor 52 includes a manifold fluidly coupled to the supply tank 51 (FIG. 4) via the pump 53 (FIG. 1). The manifold can have a plurality of outlets 57 positioned on the underside 21 of the robot 10 to deliver cleaning fluid directly to the floor surface. The outlets 57 can be positioned forwardly of the brushroll 41, and the brushroll 41 can distribute, absorb, and remove the applied cleaning fluid from the floor surface, including during a wet mode of operation of the robot 10 as described above.

In another example (not shown), a squeegee can optionally be provided on the housing 12, such as behind the brushroll 41. In such a case, the squeegee can be configured to contact the surface as the robot 10 moves across the surface to be cleaned. The squeegee can wipe any remaining residual liquid from the surface to be cleaned, thereby leaving a moisture and streak-free finish on the surface to be cleaned. In a dry application, the squeegee can prevent loose debris from being scattered by the rotating brushroll 41.

Returning to FIGS. 1-2, in one embodiment, the system 60 is a warning system connected to at least the IMU 105, and configured to alert or warn a user in instances when the robot 10 is lifted off the ground and/or tipped to a level exceeding a predetermined angle. Tipping the robot 10 can spill liquid out of the supply tank 51 and/or recovery tank 44, and either into the internal chassis of the robot 10, or onto the surface to be cleaned, both of which are undesirable. The warning system 60 can prevent a user from tipping the robot 10 to such a degree that liquid would be spilled out of one or both of the tanks 44, 51.

The warning system 60 can be triggered via input from at least one sensor, such as, but not limited to, the IMU 105 (i.e. gyroscope), the lift-up sensors 106, the cliff sensors 104, or the moisture sensor 112 inside the housing 12.

Figure 6:
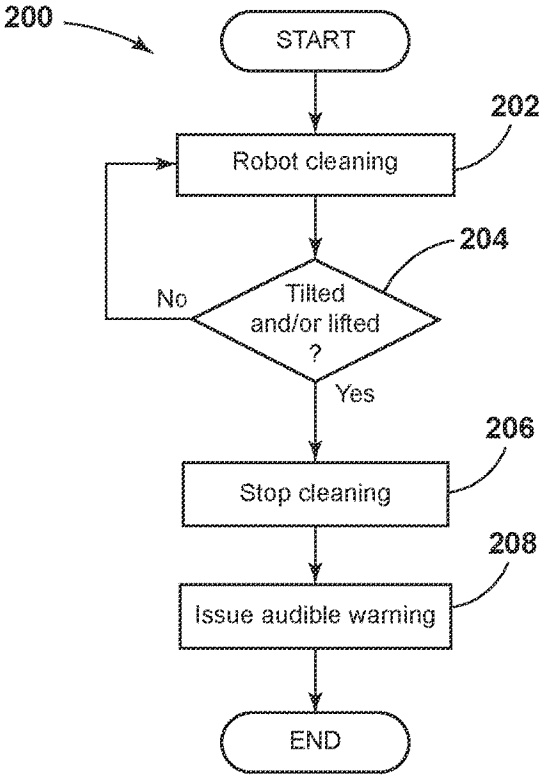
FIG. 6 is a flow chart showing a first embodiment of a method for issuing an audible warning performed by a floor cleaning robot.

FIG. 6 is a flow chart showing one embodiment of a method 200 for issuing an audible warning performed by the robot 10. The sequence of steps discussed is for illustrative purposes only and is not meant to limit the method in any way as it is understood that the steps may proceed in a different logical order, additional or intervening steps may be included, or described steps may be divided into multiple steps, without detracting from the invention.

At step 202, the robot 10 is cleaning During cleaning, the brush motor 42, vacuum motor 47, pump motor 54, and/or wheel motors 72 may be activated.

At step 204, the robot 10 checks if it is in an orientation or operational condition in which an audible warning should be issued. In one embodiment, the robot 10 uses the on-board IMU 105 to detect when the robot 10 is lifted and/or when the robot 10 is tilted to an angle not parallel to the surface to be cleaned. This can include detecting when the robot 10 is lifted completely off the surface to be cleaned, lifted or tilted partially off the surface to be cleaned, or flipped upside down. For example, the IMU 105 can detect a tilt angle of the robot 10, and when the tilt angle meets or exceeds a predetermined tilt angle, the controller 20 registers that the robot 10 is in an orientation in which an audible warning should be issued. Other tilt sensors are possible. In one embodiment, the predetermined tilt angle is a tilt angle at which liquid can spill out of the recovery tank 44. In another embodiment, the predetermined tilt angle is a tilt angle at which liquid can spill out of the supply tank 51. In yet another embodiment, the predetermined tilt angle is 20 degrees, alternatively 30 degrees, alternatively 45 degrees, alternatively 60 degrees, alternatively 90 degrees. In executing step 204, the controller 20 can determine if the detected tilt angle of the robot 10 meets or exceeds the predetermined tilt angle by comparing the detected tilt angle to the predetermined tilt angle.

Other on-board sensors can be used at step 204. For example, on another embodiment, the robot 10 can use the on-board lift-up sensors 106 to detect when the robot 10 is lifted for step 204. In yet another embodiment, the robot 10 can use the on-board cliff sensors 104 to detect when the robot 10 is lifted for step 204.

When one of these scenarios is detected, the robot 10 can optionally stop cleaning at step 206 and issue an audible warning from the on-board speaker 61, or optionally a remote speaker, at step 208. The controller 20 can direct the speaker 61 to provide the warning to the user. Optionally, a visual warning can be issued along with the audible warning at step 208.

The audible warning can be a prerecorded voice message, which can convey specific information to the user clearly. Such a voice message can directly state instructions or actions for the user. Examples include, but are not limited to, "Place the robot back on the ground before continuing, "Turn robot right-side-up before continuing," "Ensure robot is not wet before continuing," and "Allow the robot time to dry before continuing." Other voice prompts for proper use and cleaning can be issued from the speaker 61. In another embodiment, the audible warning can be issued as a series of beeps or tones.

The audible warning can be issued once, a predetermined number of times, or for a predetermination duration of time at step 208. Issuing the audible warning more than once or for an extended period of time may increase the likelihood that the user hears the alert. Optionally, the audible warning can be issued, continuously or intermittently, until the orientation or operational condition that triggered the warning is corrected.

Optionally, before, during, or after the robot 10 issues the audible warning, the robot 10 can stop cleaning as shown at step 206. Stopping cleaning may include turning off the brush motor 42, vacuum motor 47, pump motor 54, and/or wheel motors 72. Alternatively, the robot 10 may continue cleaning, or may continue to operate at least one motor while turning off at least one other motor at step 206.

Figure 7:
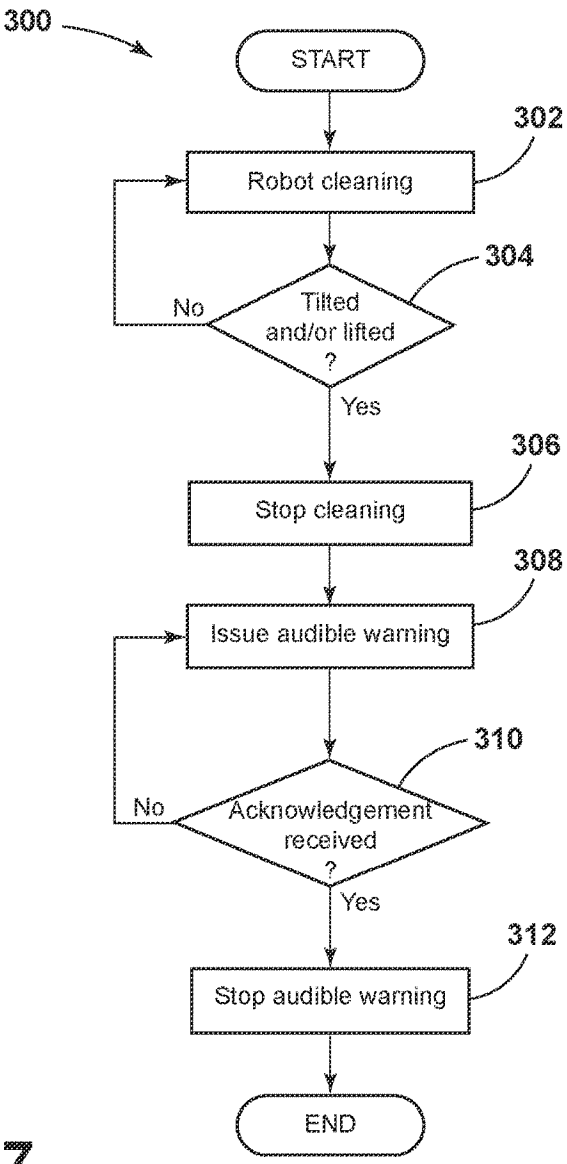
FIG. 7 is a flow chart showing a second embodiment of a method for issuing an audible warning performed by a floor cleaning robot.

FIG. 7 is a flow chart showing another embodiment of a method 300 for issuing an audible warning performed by the robot 10. The sequence of steps discussed is for illustrative purposes only and is not meant to limit the method in any way as it is understood that the steps may proceed in a different logical order, additional or intervening steps may be included, or described steps may be divided into multiple steps, without detracting from the invention.

Initially, the method 300 may proceed as described previously for the first embodiment of the method 200, with steps 302-308 being similar or identical to steps 202-208 of the method 200. For method 300, the robot 10 continues to issue the audible warning until the user acknowledges that the audible warning was received, i.e. heard by the user, at step 310.

The audible warning can be issued continuously until user acknowledgement is received at step 310. Optionally, the audible warning, for instance the prerecorded voice message, can be issued once at step 308, and if acknowledgement is not received within a predetermined timeout period at step 310, the method 300 returns to step 308 and the audible warning or prerecorded voice message is issued again. This loop can continue until user acknowledgement is received.

Acknowledging the audible warning at step 310 can comprise correcting the orientation or operational condition that triggered the audible warning. For example, the user can place the robot 10 back on the surface to be cleaned and/or adjust the robot 10 to an angle parallel to the surface to be cleaned. Input from the IMU 105 and/or lift up sensors 106 and/or cliff sensors 104 can be used to determine when the user has corrected the orientation or operational condition that triggered the audible warning.

In another embodiment, the user can provide an acknowledgement input to the controller 20 that acknowledges that the audible warning was heard/received by the user. For example, the user can press a button on the robot 10 or otherwise provide input via the user interface 90. In another example, the user can provide the acknowledgement input to the controller 20 through a mobile device, such as a smartphone or tablet, or via a voice-controlled remote device. In yet another example, the user can execute a gesture in front of the camera 130 that acknowledges that the audible warning was heard/received by the user.

Once user acknowledgement is received at step 310, the robot 10 stops issuing the audible warning at step 312.

Figure 8:
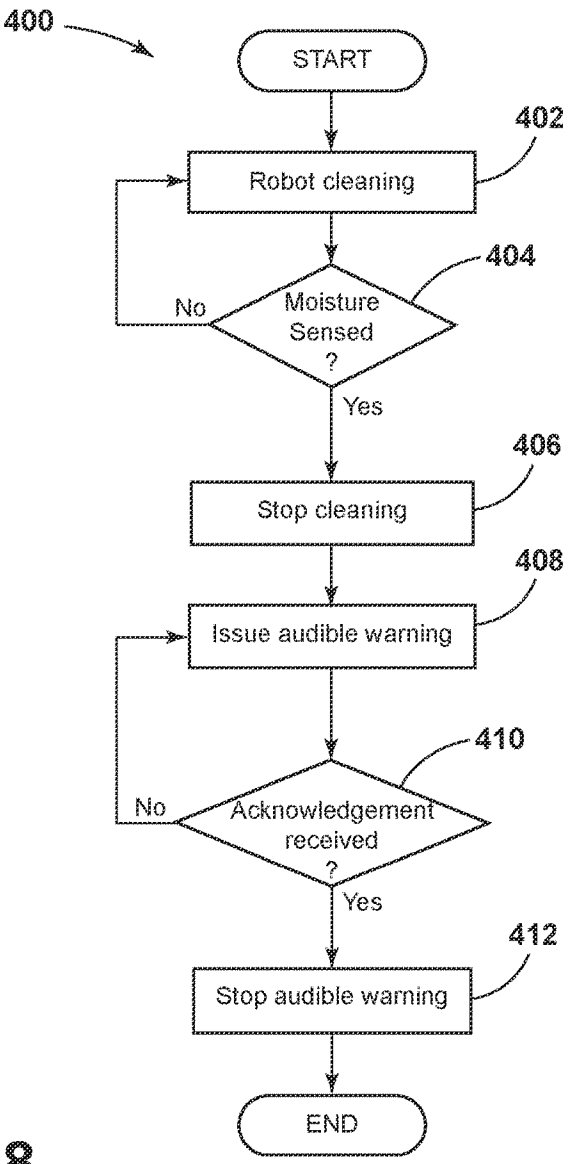
FIG. 8 is a flow chart showing a third embodiment of a method for issuing an audible warning performed by a floor cleaning robot.

FIG. 8 is a flow chart showing another embodiment of a method 400 for issuing an audible warning performed by the robot 10. The sequence of steps discussed is for illustrative purposes only and is not meant to limit the method in any way as it is understood that the steps may proceed in a different logical order, additional or intervening steps may be included, or described steps may be divided into multiple steps, without detracting from the invention.

At step 402, the robot 10 is cleaning During cleaning, the brush motor 42, vacuum motor 47, pump motor 54, and/or wheel motors 72 may be activated.

At step 404, the robot 10 checks if moisture is sensed within the robot 10, which is an operational condition in which an audible warning should be issued. Moisture can be sensed at a location within the robot 10 that is typically dry, such as a location inside the housing 12 of the robot 10 but outside the supply tank or recovery tank. Sensing moisture at such a location can be indicative of a spill inside the robot 10, for example by liquid spilling out of the supply tank 51 or recovery tank 44. In one embodiment, the robot 10 uses the on-board moisture sensor 112 to detect moisture inside the housing 12.

If moisture is detected, the method 400 may proceed as described previously for the second embodiment of the method 300, with steps 406-412 being similar or identical to steps 306-312 of the method 300. Optionally, the audible warning issued at step 408 can be a voice prompt instructing the user to allow the robot 10 to dry before powering on.

Acknowledging the audible warning at step 410 can comprise user acknowledgement input to the controller 20 as described previously, or can comprise a correction of the operational condition. For example, input from the moisture sensor 112 can be used to determine when the user has allowed to robot 10 to dry.

In another embodiment, the audible warning can be issued once, a predetermined number of times, or for a predetermination duration of time at step 408, and, similarly to method 200, may stop without requiring user acknowledgement.

Figure 9:
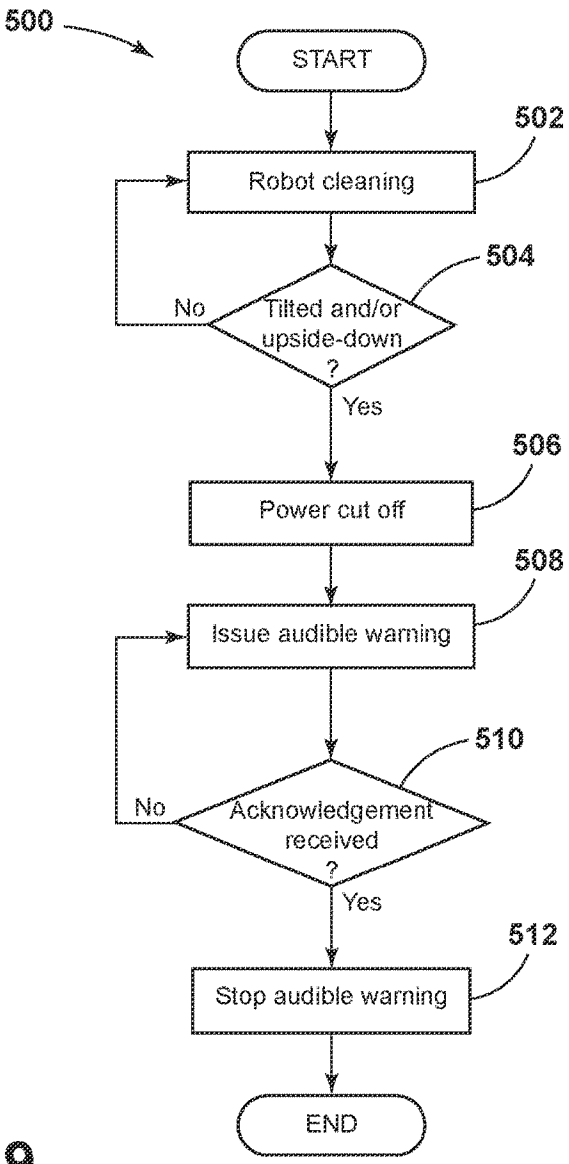
FIG. 9 is a flow chart showing a fourth embodiment of a method for issuing an audible warning performed by a floor cleaning robot.

FIG. 9 is a flow chart showing another embodiment of a method 500 for issuing an audible warning performed by the robot 10. The sequence of steps discussed is for illustrative purposes only and is not meant to limit the method in any way as it is understood that the steps may proceed in a different logical order, additional or intervening steps may be included, or described steps may be divided into multiple steps, without detracting from the invention.

At step 502, the robot 10 is cleaning. During cleaning, the brush motor 42, vacuum motor 47, pump motor 54, and/or wheel motors 72 may be activated.

At step 504, the robot 10 checks if the robot 10 is tilted past a predetermined tilt angle and/or flipped upside down. In one embodiment, the robot 10 uses the on-board IMU 105 to detect when the robot 10 is tilted to a predetermined tilt angle or flipped upside down. For example, the IMU 105 can detect a tilt angle of the robot 10, and when the tilt angle meets or exceeds a predetermined tilt angle, the controller 20 registers that the robot 10 is in an orientation in which an audible warning should be issued. Other tilt sensors are possible. In one embodiment, the predetermined tilt angle is a tilt angle at which liquid can spill out of the recovery tank 44 and/or supply tank 51. In another embodiment, the predetermined tilt angle is a tilt angle at which the robot 10 is flipped upside down. In yet another embodiment, the predetermined tilt angle is 20 degrees, alternatively 30 degrees, alternatively 45 degrees, alternatively 60 degrees, alternatively 90 degrees. In executing step 504, the controller 20 can determine if the detected tilt angle of the robot 10 meets or exceeds the predetermined tilt angle by comparing the detected tilt angle to the predetermined tilt angle.

When one of these scenarios is detected, an electrical power cut-off can be activated at step 506. The electrical power cut-off can stop power supply to multiple electrical components of the robot 10. In one embodiment, the electrical power cut-off can stop power supply to all electrical components of the robot 10, save for the controller 20, speaker 61, speaker driver 62, and optionally the user interface 90. One example of a suitable electrical power cut-off is a tilt switch that switches off one or more electrical components of the robot 10 at a predetermined orientation or inclination.

After step 506, the method 500 may proceed as described previously for the second embodiment of the method 300, with steps 508-512 being similar or identical to steps 308-312 of the method 300.

Optionally, the audible warning issued at step 508 can be a voice prompt instructing the user to place the robot 10 back on the floor, right-side-up, ensure the robot 10 did not get wet, and/or only press a reset button if the user verifies that the robot 10 is suitably dry to operate properly.

Acknowledging the audible warning at step 510 can comprise user acknowledgement input to the controller 20 as described previously, or can comprise a correction of the operational condition. For example, input from the IMU can be used to determine when the robot 10 is right-side-up, and input from the moisture sensor 112 can be used to determine when the robot 10 suitably dry to operate properly.

There are several advantages of the present disclosure arising from the various aspects or features of the apparatus, systems, and methods described herein. For example, aspects described above provide an autonomous cleaning robot with a warning system that provides audible warnings when the robot is improperly oriented or otherwise being used incorrectly. The various embodiments of the warning system and related methods disclosed herein addresses unintended user/robot interaction. Embodiments disclosed herein discourage improper use of the robot, and in some cases require the user to acknowledge proper condition of the robot for safe operation. Previously, such information was available to the user only via labels on the robot or in user guides.

Another advantage of aspects of the disclosure relates to wet cleaning robots. Embodiments disclosed herein provide the user with warnings when the robot is lifted, tilted, upside-down, or when or moisture is present inside the robot. The various embodiments of the warning system and related methods disclosed herein can reduce the likelihood that a user will accidentally try to turn a wet cleaning robots robot over and attempt to use the wet cleaning robot when moisture is or may be present inside the housing 12. Embodiments disclosed herein discourage improper use of a wet cleaning robot, and in some cases prevent improper use of a wet cleaning robot by cutting off power supply when the interior of the robot is or may be wet.

To the extent not already described, the different features and structures of the various embodiments of the invention, may be used in combination with each other as desired, or may be used separately. That one autonomous floor cleaner or floor cleaning robot is illustrated herein as having all of these features does not mean that all of these features must be used in combination, but rather done so here for brevity of description. It is noted that while the methods 200, 300, 400, 500 are described with respect to the embodiment of the robot 10 shown herein, the methods 200, 300, 400, 500 can also be applied to other robots. Further, while multiple methods are disclosed herein, one of the disclosed methods may be performed independently, or more than one of the disclosed methods, including any combination of methods disclosed herein may be performed by one robot. Thus, the various features of the different embodiments may be mixed and matched in various cleaning apparatus configurations as desired to form new embodiments, whether or not the new embodiments are expressly described.

The above description relates to general and specific embodiments of the disclosure. However, various alterations and changes can be made without departing from the spirit and broader aspects of the disclosure as defined in the appended claims, which are to be interpreted in accordance with the principles of patent law including the doctrine of equivalents. As such, this disclosure is presented for illustrative purposes and should not be interpreted as an exhaustive description of all embodiments of the disclosure or to limit the scope of the claims to the specific elements illustrated or described in connection with these embodiments. Any reference to elements in the singular, for example, using the articles "a," "an," "the," or "said," is not to be construed as limiting the element to the singular.

Likewise, it is also to be understood that the appended claims are not limited to express and particular components or methods described in the detailed description, which may vary between particular embodiments that fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

What is claimed is:

1. An autonomous floor cleaner, comprising:
- an autonomously moveable housing;
- a controller;
- a drive system adapted to autonomously move the housing over a surface to be cleaned;
- a tank adapted to hold liquid; and
- a speaker;
- a tilt sensor configured to detect a tilt angle of the autonomous floor cleaner and provide this information as an input to the controller; and
- wherein the controller is configured to:
  - operate the drive system to control autonomous movement of the housing over the surface to be cleaned; and
  - issue an audible warning from the speaker in response to the detected tilt angle meeting or exceeding a predetermined tilt angle.

2. The autonomous floor cleaner of claim 1, wherein the predetermined tilt angle is an angle at which liquid can spill out of the tank.

3. The autonomous floor cleaner of claim 1, comprising a fluid delivery system including a fluid distributor in fluid communication with the tank, wherein the tank is a supply tank storing a supply of cleaning fluid.

4. The autonomous floor cleaner of claim 3, comprising a collection system including a recovery pathway through the housing having an inlet defined by a suction nozzle, a recovery tank, and a suction source in fluid communication with the suction nozzle and the recovery tank for generating a working air stream through the recovery pathway.

5. The autonomous floor cleaner of claim 1, wherein the tank is a recovery tank configured to receive liquid collected from the surface to be cleaned.

6. The autonomous floor cleaner of claim 1, comprising a speaker driver that controls the speaker and acts as an interface between the controller and the speaker, wherein the speaker and the speaker driver are on-board the autonomously moveable housing.

7. The autonomous floor cleaner of claim 1, comprising at least one camera configured to detect a user gesture acknowledging the audible warning, wherein the controller is configured to stop issuing the audible warning in response to the camera detecting the user gesture.

8. The autonomous floor cleaner of claim 1, wherein the tilt sensor comprises one of an inertial measurement unit and a gyroscope.

9. The autonomous floor cleaner of claim 1, comprising at least one of:

a lift-up sensor configured to detect when the autonomous floor cleaner is lifted off the surface to be cleaned, wherein the controller is configured to issue an audible warning from the speaker in response to the detection of the autonomous floor cleaner being lifted off the surface to be cleaned; and a moisture sensor configured to detect moisture inside the housing, wherein the controller is configured to issue an audible warning from the speaker in response to the detection of moisture inside the housing.

10. A method for issuing an audible warning for an autonomous floor cleaner, the autonomous floor cleaner having an autonomously moveable housing, a controller, a drive system operably coupled with the controller and adapted to autonomously move the housing over the surface to be cleaned, and a tank adapted to hold liquid, the method comprising:

detecting, with an on-board tilt sensor, a tilt angle of the autonomous floor cleaner;

determining if the tilt angle of the autonomous floor cleaner meets or exceeds a predetermined tilt angle;

issuing an audible warning when the tilt angle of the autonomous floor cleaner meets or exceeds the predetermined tilt angle.

11. The method of claim 10, wherein the predetermined tilt angle is an angle at which liquid can spill out of the tank.

12. The method of claim 10, wherein the tank is one of:

a recovery tank, wherein the predetermined tilt angle is an angle at which liquid can spill out of the recovery tank; and a supply tank, wherein the predetermined tilt angle is an angle at which liquid can spill out of the supply tank.

13. The method of claim 10, comprising:

performing a cleaning operation on a surface while autonomously moving the housing over the surface, wherein performing the cleaning operation comprises activating at least one motor; and stopping the cleaning operation when the tilt angle of the autonomous floor cleaner meets or exceeds the predetermined tilt angle, wherein stopping the cleaning operation comprises deactivating the at least one motor.

14. The method of claim 13, wherein the at least one motor is selected from a group comprising:

a brush motor, a vacuum motor, a pump motor, and a wheel motor.

15. The method of claim 10, comprising:

performing a cleaning operation on a surface while autonomously moving the housing over the surface, wherein performing the cleaning operation comprises activating at least one motor; and activating an electrical power cut-off when the tilt angle of the autonomous floor cleaner meets or exceeds the predetermined tilt angle, wherein activating the electrical power cut-off comprises cutting off a supply of power to multiple electrical components of the autonomous floor cleaner.

16. The method of claim 10, wherein issuing the audible warning comprises issuing a prerecorded voice message from an on-board speaker.

17. The method of claim 10, comprising determining if a user acknowledgement of the audible warning is received by the controller; and issuing a second audible warning if the user acknowledgement of the audible warning is not received within a predetermined timeout period.

18. The method of claim 10, comprising:

determining if a user acknowledgement of the audible warning is received by the controller; and stopping the audible warning if the user acknowledgement of the audible warning is received.

19. The method of claim 18, wherein:

determining if the user acknowledgement of the audible warning is received comprises determining if the tilt angle of the autonomous floor cleaner is less than the predetermined tilt angle.

stopping the audible warning if the user acknowledgement of the audible warning is received stopping the audible warning when the tilt angle is less than the predetermined tilt angle.

20. The method of claim 10, comprising at least one of:

issuing an audible warning upon detection of the autonomous floor cleaner being lifted off the surface to be cleaned by an on-board lift-up sensor; and issuing an audible warning upon moisture being detected at a location within the housing outside the tank by an on-board moisture sensor.

* * * * *